US011276272B2

(12) United States Patent
Casey et al.

(10) Patent No.: US 11,276,272 B2
(45) Date of Patent: Mar. 15, 2022

(54) SYSTEMS AND METHODS FOR ELECTRONIC GAMING USING HISTORICAL DATA

(71) Applicant: Aristocrat Technologies, Inc., Las Vegas, NV (US)

(72) Inventors: Michael Casey, Reno, NV (US); Rex R. Carlson, Henderson, NV (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 17 days.

(21) Appl. No.: 16/852,061

(22) Filed: Apr. 17, 2020

(65) Prior Publication Data

US 2021/0327213 A1 Oct. 21, 2021

(51) Int. Cl.
*G07F 17/34* (2006.01)
*G07F 17/32* (2006.01)

(52) U.S. Cl.
CPC ..... *G07F 17/3227* (2013.01); *G07F 17/3209* (2013.01); *G07F 17/3213* (2013.01); *G07F 17/3244* (2013.01); *G07F 17/3262* (2013.01); *G07F 17/3288* (2013.01); *G07F 17/34* (2013.01)

(58) Field of Classification Search
CPC ..... G07F 17/3277; G07F 17/3209; G07F 17/3213; G07F 17/3244; G07F 17/3262; G07F 17/3288; G07F 17/34
See application file for complete search history.

(56) References Cited

U.S. PATENT DOCUMENTS

| | | | | |
|---|---|---|---|---|
| 6,358,150 | B1 | 3/2002 | Mir et al. | |
| 6,450,887 | B1 | 9/2002 | Mir et al. | |
| 9,047,737 | B2 | 6/2015 | Brooks et al. | |
| 9,437,078 | B2 | 9/2016 | Keech | |
| 9,443,392 | B2 | 9/2016 | Keech | |
| 9,747,748 | B2 * | 8/2017 | Corckran | G07F 17/3258 |
| 10,395,471 | B2 | 8/2019 | Lind et al. | |
| 2008/0176635 | A1 * | 7/2008 | Randall | G07F 17/34 463/20 |
| 2014/0274350 | A1 | 9/2014 | Herbert | |
| 2015/0018085 | A1 | 1/2015 | Herbert | |
| 2015/0262452 | A1 * | 9/2015 | Corckran | G07F 17/3295 463/28 |
| 2017/0372561 | A1 | 12/2017 | Aronson et al. | |

(Continued)

*Primary Examiner* — Corbett B Coburn
(74) *Attorney, Agent, or Firm* — Armstrong Teasdale LLP

(57) ABSTRACT

In one aspect, an electronic gaming machine is described. The electronic gaming machine includes at least one display device, a player input interface, a credit input mechanism, and a game controller configured to execute instructions. When executed by the game controller, the instructions cause the game controller to select a set of historical events from a plurality of sets of historical events for use in a wagering game, select a plurality of arrangements of historical event data, and determine a plurality of sub-wagers from a received credit wager. The instructions further cause the game controller to assign each sub-wager of the plurality of sub-wagers to a different arrangement of the historical event data and determine an outcome of the wagering game by applying the historical event data for the set of historical events to each of the different arrangements of the historical event data having a sub-wager assigned thereto.

20 Claims, 6 Drawing Sheets

(56) References Cited

U.S. PATENT DOCUMENTS

| | | | | |
|---|---|---|---|---|
| 2019/0122502 | A1 | 8/2019 | Aronson et al. | |
| 2019/0251789 | A1* | 8/2019 | Waters | G07F 17/3244 |
| 2019/0325707 | A1 | 10/2019 | Aronson et al. | |
| 2020/0286333 | A1 | 9/2020 | Waters | |

* cited by examiner

600

| 602 | 604 | 606 | 608 | 610 |
|---|---|---|---|---|
| RACE 1 | W1 | 1,2,3 | W2 | 2,4 |
| RACE 2 | W3 | 1 | | |
| RACE 3 | W4 | 2,3,4 | | |
| RACE 4 | W5 | 1,2 | | |

FIG. 6

700

| 702 | 704 |
|---|---|
| RACE 1 | 1,2,3 |
| RACE 2 | 1,5 |
| RACE 3 | 3 |
| RACE 4 | 4,5 |
| RACE 5 | 1 |
| RACE 6 | 1,2 |
| RACE 7 | 2,4 |
| RACE 8 | 4,5 |
| RACE 9 | 2 |
| RACE 10 | 3,4 |

FIG. 7A

710

| 702 | 712 |
|---|---|
| RACE 1 | 4 |
| RACE 2 | |
| RACE 3 | |
| RACE 4 | 1 |
| RACE 5 | |
| RACE 6 | 1,2 |
| RACE 7 | 2,3,4 |
| RACE 8 | |
| RACE 9 | 2,3 |
| RACE 10 | 1 |

FIG. 7B

SYSTEMS AND METHODS FOR ELECTRONIC GAMING USING HISTORICAL DATA

TECHNICAL FIELD

The field of disclosure relates generally to electronic gaming using historical data, and more particularly to electronic gaming using historical horse race outcomes.

BACKGROUND

Electronic gaming machines ("EGMs") or gaming devices provide a variety of wagering games such as slot games, video poker games, video blackjack games, roulette games, video bingo games, keno games, and other types of games that are frequently offered at casinos and other locations. Play on EGMs typically involves a player establishing a credit balance by inputting money, or another form of monetary credit, and placing a monetary wager (from the credit balance) on one or more outcomes of an instance (or single play) of a primary or base game. In some cases, a player may qualify for a special mode of the base game, a secondary game, or a bonus round of the base game by attaining a certain winning combination or triggering event in, or related to, the base game, or after the player is randomly awarded the special mode, secondary game, or bonus round. In the special mode, secondary game, or bonus round, the player is given an opportunity to win extra game credits, game tokens or other forms of payout. In the case of "game credits" that are awarded during play, the game credits are typically added to a credit meter total on the EGM and can be provided to the player upon completion of a gaming session or when the player wants to "cash out."

"Slot" type games are often displayed to the player in the form of various symbols arrayed in a row-by-column grid or matrix. Specific matching combinations of symbols along predetermined paths (or paylines) through the matrix indicate the outcome of the game. The display typically highlights winning combinations/outcomes for ready identification by the player. Matching combinations and their corresponding awards are usually shown in a "pay-table" which is available to the player for reference. Often, the player may vary his/her wager to include differing numbers of paylines and/or the amount bet on each line. By varying the wager, the player may sometimes alter the frequency or number of winning combinations, frequency or number of secondary games, and/or the amount awarded.

Typical games use a random number generator (RNG) to randomly determine the outcome of each game. The game is designed to return a certain percentage of the amount wagered back to the player over the course of many plays or instances of the game, which is generally referred to as return to player (RTP). The RTP and randomness of the RNG ensure the fairness of the games and are highly regulated. Upon initiation of play, the RNG randomly determines a game outcome and symbols are then selected which correspond to that outcome. Notably, some games may include an element of skill on the part of the player and are therefore not entirely random.

Some known EGMs may also use historical horse racing results to determine wagering game outcomes. These known systems are highly complicated and require multiple sets of historical horse racing results for each wager and/or sub-wager thereof. These known systems also require a considerable amount of computing resources for processing the multiple sets of racing results. Accordingly, systems and methods are desired that determine wagering game outcomes in a more efficient way while still utilizing historical horse racing results and being complex enough so as to prevent a player from predicting which horse race or set(s) of horse races are being used in a particular play of a wagering game.

BRIEF DESCRIPTION

In one aspect, an electronic gaming machine is described. The electronic gaming machine includes at least one display device, a player input interface configured to receive player input from a player, a credit input mechanism including at least one of a card reader, a ticket reader, a bill acceptor, and a coin input mechanism, the credit input mechanism configured to receive a credit wager, and a game controller configured to execute instructions stored in a tangible, non-transitory, computer-readable storage medium. When executed by the game controller, the instructions cause the game controller to at least select a set of historical events from a plurality of sets of historical events for use in a wagering game, each of the plurality of sets of historical events having historical event data associated therewith and stored in a memory, select a plurality of arrangements of historical event data for the set of historical events, and determine a plurality of sub-wagers from a received credit wager. The instructions also cause the game controller to assign each sub-wager of the plurality of sub-wagers to a different arrangement of the historical event data for the set of historical events and determine an outcome of the wagering game by applying the historical event data for the set of historical events to each of the different arrangements of the historical event data having a sub-wager assigned thereto.

In another aspect, a gaming system is described. The gaming system includes at least one display device, a player input interface configured to receive player input from a player, a processor for controlling a wagering game, and a tangible, non-transitory, computer-readable storage medium having instructions stored thereon. The instructions, in response to execution by the processor, cause the processor to perform operations including selecting a set of historical events from a plurality of sets of historical events for use in a wagering game, each of the plurality of sets of historical events having historical event data associated therewith and stored in a memory, selecting a plurality of arrangements of historical event data for the set of historical events, and determining a plurality of sub-wagers from a received credit wager. The instructions also cause the processor to perform operations including assigning each sub-wager of the plurality of sub-wagers to a different arrangement of the historical event data for the set of historical events and determining an outcome of the wagering game by applying the historical event data for the set of historical events to each of the different arrangements of the historical event data having a sub-wager assigned thereto.

In yet another aspect, a method for electronic gaming on an electronic gaming machine is described. The electronic gaming machine includes at least one display device, a player input interface configured to receive player input from a player, a credit input mechanism including at least one of a card reader, a ticket reader, a bill acceptor, and a coin input mechanism, the credit input mechanism configured to receive a credit wager, and a game controller configured to execute instructions stored in a tangible, non-transitory, computer-readable storage medium. The method includes selecting a set of historical events from a plurality of sets of historical events for use in a wagering game, each of the plurality of sets of historical events having historical event data associated therewith and stored in a memory, selecting a plurality of arrangements of historical event data for the set of historical events, and determining a plurality of sub-wagers from a received credit wager. The method also includes assigning each sub-wager of the plurality of sub-wagers to a different arrangement of the historical event data for the set of historical events and determining an outcome of the wagering game by applying the historical event data for the set of historical events to each of the different arrangements of the historical event data having a sub-wager assigned thereto.

BRIEF DESCRIPTION OF THE DRAWINGS

FIG. 6 is an exemplary diagram showing a plurality of wagers matched to a plurality of historical event outcomes in accordance with the present disclosure.

FIGS. 7A and 7B illustrate exemplary diagrams each demonstrating a set of historical data and arrangements of historical data.

DETAILED DESCRIPTION

The systems and methods described herein provide for conducting wagering games using historical data that includes historical horse racing data. More specifically, the systems and methods described herein include a gaming machine that conducts wagering games using historical horse racing data. The machine is referred to as a historical horse racing ("HHR") machine. The HHR machine conducts wagering games using parimutuel betting wherein the wagers are placed in a pool, an amount is deducted as a "house-take," and payouts are determined by sharing the pool among all winning wagers.

In some known HHR systems, a wager placed by a player at the HHR machine can be split into a plurality of smaller wagers (e.g., sub-wagers). However, in the example embodiment, each of the plurality of sub-wagers are assigned to different arrangements (e.g., different paytables) of a set of historical data (e.g., a set of historical race outcomes). In some embodiments, a wager may not be split into a plurality of sub-wagers, and the wager is assigned to an arrangement of a set of historical data. Because in the system described herein only one set of historical data is used for each wager, as opposed to each wager being assigned to different sets of historical data, designers can more easily create HHR games, players can more easily understand HHR games, and EGMs can more efficiently conduct HHR games.

Further, the HHR games described herein provide for better efficiencies of EGMs because only one set of historical data, as opposed to multiple sets of historical data, are used for any particular wager. Thus, less computing resources are required than in traditional historical horse racing games described above. Further, because more than one race may be included in a set of historical horse racing data, it would be extremely difficult for a player to predict which races and/or arrangements of historical horse racing data are being used during play of the HHR game.

Figure 1:
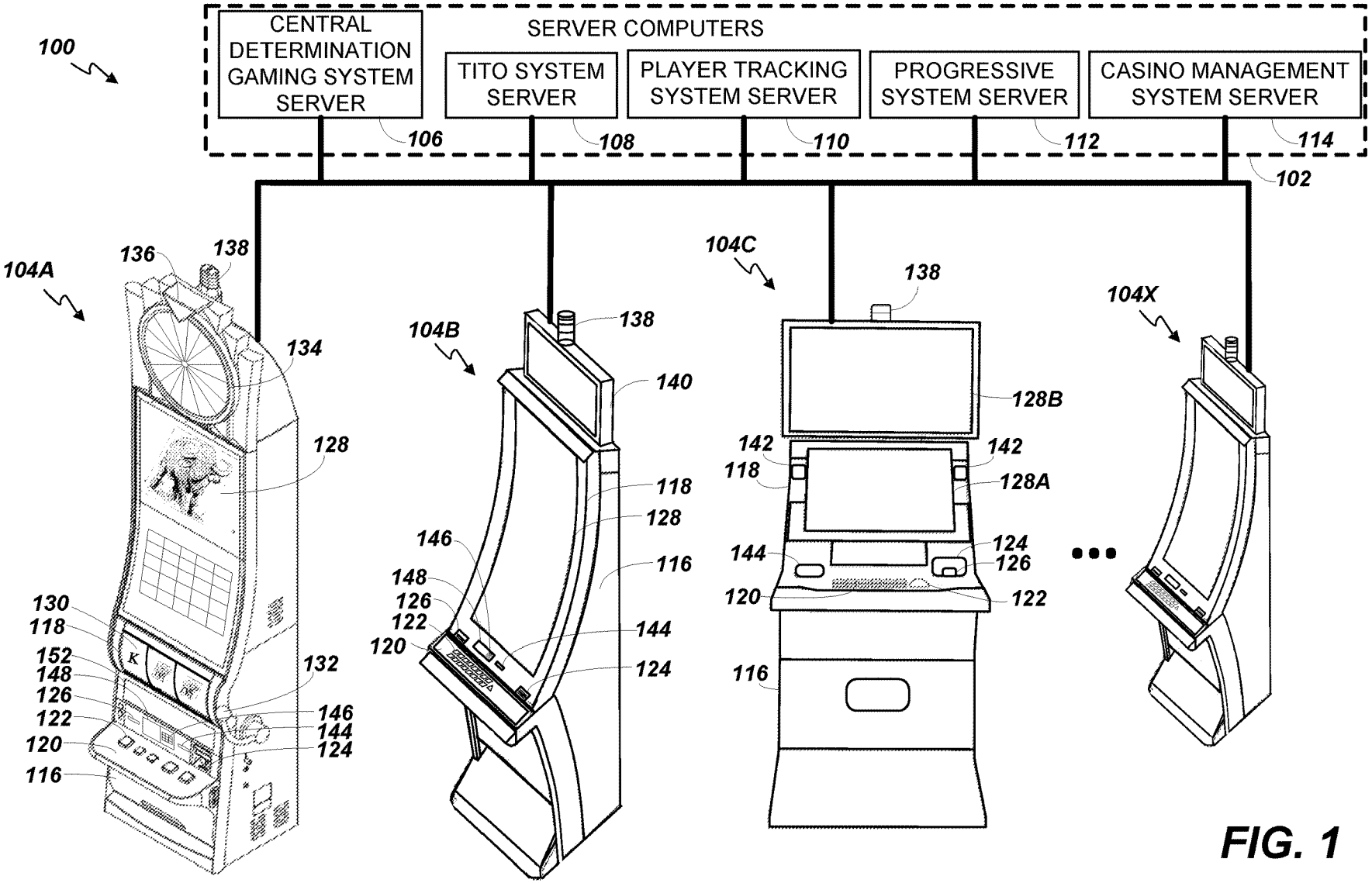
FIG. 1 is an exemplary diagram showing several EGMs networked with various gaming related servers.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console. Gaming devices 104A-104X utilize specialized software and/or hardware to form non-generic, particular machines or apparatuses that comply with regulatory requirements regarding devices used for wagering or games of chance that provide monetary awards.

Communication between the gaming devices 104A-104X and the server computers 102, and among the gaming devices 104A-104X, may be direct or indirect using one or more communication protocols. As an example, gaming devices 104A-104X and the server computers 102 can communicate over one or more communication networks, such as over the Internet through a website maintained by a computer on a remote server or over an online data network including commercial online service providers, Internet service providers, private networks (e.g., local area networks and enterprise networks), and the like (e.g., wide area networks). The communication networks could allow gaming devices 104A-104X to communicate with one another and/or the server computers 102 using a variety of communication-based technologies, such as radio frequency (RF) (e.g., wireless fidelity (WiFi®) and Bluetooth®), cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming device 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming device 104A can have hardware meters for purposes including ensuring regulatory compliance and monitoring the player credit balance. In addition, there can be additional meters that record the total amount of money wagered on the gaming device, total amount of money deposited, total amount of money withdrawn, total amount of winnings on gaming device 104A.

In some embodiments, a player tracking card reader 144, a transceiver for wireless communication with a mobile device (e.g., a player's smartphone), a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
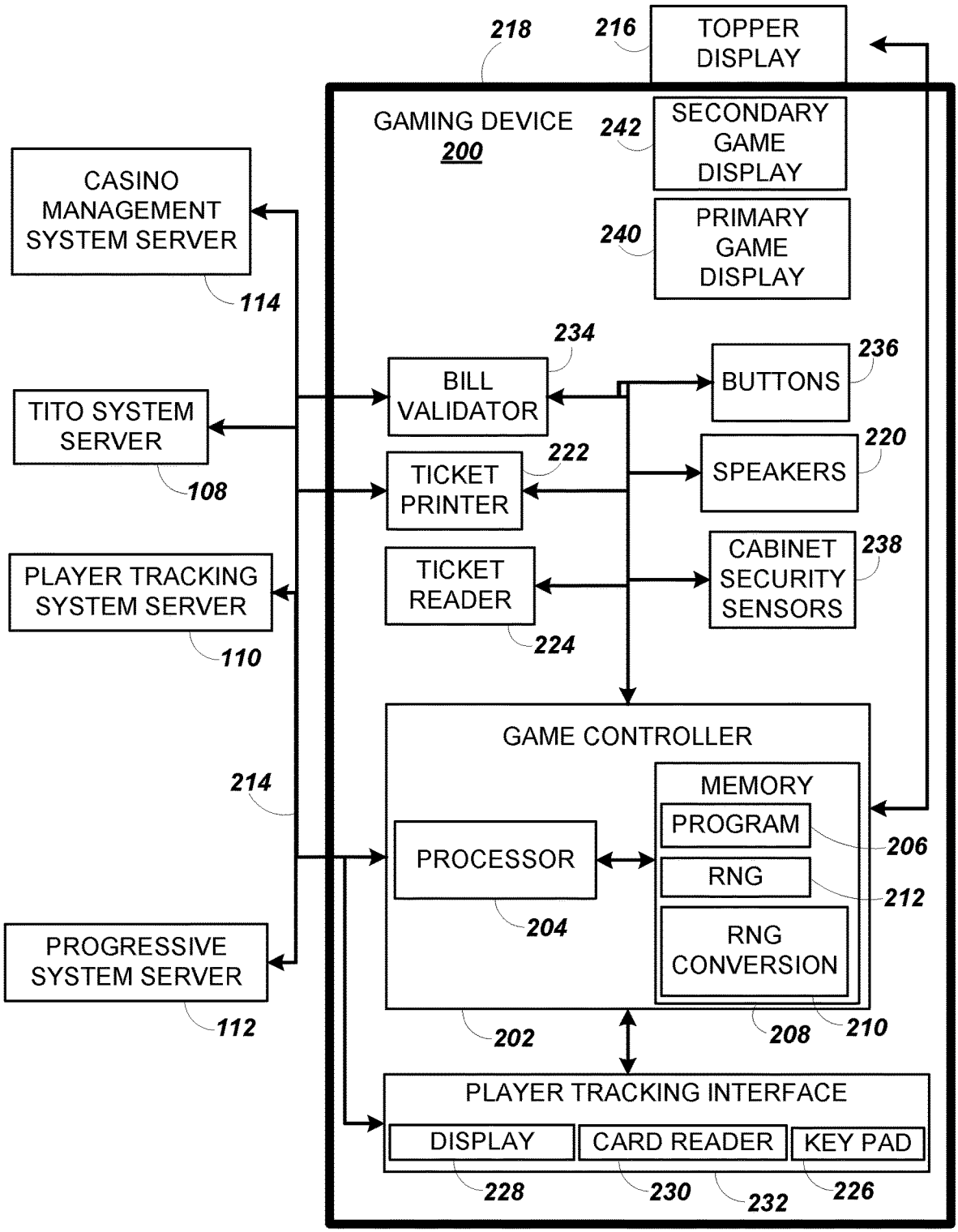
FIG. 2 is a block diagram showing various functional elements of an exemplary EGM.

Many or all the above described components can be controlled by circuitry (e.g., a game controller) housed inside the main cabinet 116 of the gaming device 104A, the details of which are shown in FIG. 2.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door which opens to provide access to the interior of the gaming device 104B. The main or service door is typically used by service personnel to refill the ticket-out printer 126 and collect bills and tickets inserted into the bill validator 124. The main or service door may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, HHR, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. As shown in FIG. 2, gaming device 200 includes a topper display 216 or another form of a top box (e.g., a topper wheel, a topper screen, etc.) that sits above cabinet 218.

Cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. Player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. FIG. 2 also depicts utilizing a ticket printer 222 to print tickets for a TITO system server 108. Gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

The games available for play on the gaming device 200 are controlled by a game controller 202 that includes one or more processors 204. Processor 204 represents a general-purpose processor, a specialized processor intended to perform certain functional tasks, or a combination thereof. As an example, processor 204 can be a central processing unit (CPU) that has one or more multi-core processing units and memory mediums (e.g., cache memory) that function as buffers and/or temporary storage for data. Alternatively, processor 204 can be a specialized processor, such as an application specific integrated circuit (ASIC), graphics processing unit (GPU), field-programmable gate array (FPGA), digital signal processor (DSP), or another type of hardware accelerator. In another example, processor 204 is a system on chip (SoC) that combines and integrates one or more general-purpose processors and/or one or more specialized processors. Although FIG. 2 illustrates that game controller 202 includes a single processor 204, game controller 202 is not limited to this representation and instead can include multiple processors 204 (e.g., two or more processors).

FIG. 2 illustrates that processor 204 is operatively coupled to memory 208. Memory 208 is defined herein as including volatile and nonvolatile memory and other types of non-transitory data storage components. Volatile memory is memory that do not retain data values upon loss of power. Nonvolatile memory is memory that do retain data upon a loss of power. Examples of memory 208 include random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, examples of RAM include static random access memory (SRAM), dynamic random access memory (DRAM), magnetic random access memory (MRAM), and other such devices. Examples of ROM include a programmable read-only memory (PROM), an erasable programmable read-only memory (EPROM), an electrically erasable programmable read-only memory (EEPROM), or other like memory device. Even though FIG. 2 illustrates that game controller 202 includes a single memory 208, game controller 202 could include multiple memories 208 for storing program instructions and/or data.

Memory 208 can store one or more game programs 206 that provide program instructions and/or data for carrying out various embodiments (e.g., game mechanics) described herein. Stated another way, game program 206 represents an executable program stored in any portion or component of memory 208. In one or more embodiments, game program 206 is embodied in the form of source code that includes human-readable statements written in a programming language or machine code that contains numerical instructions recognizable by a suitable execution system, such as a processor 204 in a game controller or other system. Examples of executable programs include: (1) a compiled program that can be translated into machine code in a format that can be loaded into a random access portion of memory 208 and run by processor 204; (2) source code that may be expressed in proper format such as object code that is capable of being loaded into a random access portion of memory 208 and executed by processor 204; and (3) source code that may be interpreted by another executable program to generate instructions in a random access portion of memory 208 to be executed by processor 204.

Alternatively, game programs 206 can be setup to generate one or more game instances based on instructions and/or data that gaming device 200 exchange with one or more remote gaming devices, such as a central determination gaming system server 106 (not shown in FIG. 2 but shown in FIG. 1). For purpose of this disclosure, the term "game instance" refers to a play or a round of a game that gaming device 200 presents (e.g., via a user interface (UI)) to a player. The game instance is communicated to gaming device 200 via the network 214 and then displayed on gaming device 200. For example, gaming device 200 may execute game program 206 as video streaming software that allows the game to be displayed on gaming device 200. When a game is stored on gaming device 200, it may be loaded from memory 208 (e.g., from a read only memory (ROM)) or from the central determination gaming system server 106 to memory 208.

Gaming devices, such as gaming device 200, are highly regulated to ensure fairness and, in many cases, gaming device 200 is operable to award monetary awards (e.g., typically dispensed in the form of a redeemable voucher). Therefore, to satisfy security and regulatory requirements in a gaming environment, hardware and software architectures are implemented in gaming devices 200 that differ significantly from those of general-purpose computers. Adapting general purpose computers to function as gaming devices 200 is not simple or straightforward because of: (1) the regulatory requirements for gaming devices 200, (2) the harsh environment in which gaming devices 200 operate, (3) security requirements, (4) fault tolerance requirements, and (5) the requirement for additional special purpose componentry enabling functionality of an EGM. These differences require substantial engineering effort with respect to game design implementation, game mechanics, hardware components, and software.

One regulatory requirement for games running on gaming device 200 generally involves complying with a certain level of randomness. Typically, gaming jurisdictions mandate that gaming devices 200 satisfy a minimum level of randomness without specifying how a gaming device 200 should achieve this level of randomness. To comply, FIG. 2 illustrates that gaming device 200 includes an RNG 212 that utilizes hardware and/or software to generate RNG outcomes that lack any pattern. The RNG operations are often specialized and non-generic in order to comply with regulatory and gaming requirements. For example, in a reel game, game program 206 can initiate multiple RNG calls to RNG 212 to generate RNG outcomes, where each RNG call and RNG outcome corresponds to an outcome for a reel. In another example, gaming device 200 can be a Class II gaming device where RNG 212 generates RNG outcomes for creating Bingo cards. In one or more embodiments, RNG 212 could be one of a set of RNGs operating on gaming device 200. More generally, an output of the RNG 212 can be the basis on which game outcomes are determined by the game controller 202. Game developers could vary the degree of true randomness for each RNG (e.g., pseudorandom) and utilize specific RNGs depending on game requirements. The output of the RNG 212 can include a random number or pseudorandom number (either is generally referred to as a "random number").

Another regulatory requirement for running games on gaming device 200 includes ensuring a certain level of RTP. Similar to the randomness requirement discussed above, numerous gaming jurisdictions also mandate that gaming device 200 provides a minimum level of RTP (e.g., RTP of at least 75%). A game can use one or more lookup tables (also called weighted tables) as part of a technical solution that satisfies regulatory requirements for randomness and RTP. In particular, a lookup table can integrate game features (e.g., trigger events for special modes or bonus games; newly introduced game elements such as extra reels, new symbols, or new cards; stop positions for dynamic game elements such as spinning reels, spinning wheels, or shifting reels; or card selections from a deck) with random numbers generated by one or more RNGs, so as to achieve a given level of volatility for a target level of RTP. (In general, volatility refers to the frequency or probability of an event such as a special mode, payout, etc. For example, for a target level of RTP, a higher-volatility game may have a lower payout most of the time with an occasional bonus having a very high payout, while a lower-volatility game has a steadier payout with more frequent bonuses of smaller amounts.) Configuring a lookup table can involve engineering decisions with respect to how RNG outcomes are mapped to game outcomes for a given game feature, while still satisfying regulatory requirements for RTP. Configuring a lookup table can also involve engineering decisions about whether different game features are combined in a given entry of the lookup table or split between different entries (for the respective game features), while still satisfying regulatory requirements for RTP and allowing for varying levels of game volatility.

FIG. 2 illustrates that gaming device 200 includes an RNG conversion engine 210 that translates the RNG outcome from RNG 212 to a game outcome presented to a player. To meet a designated RTP, a game developer can setup the RNG conversion engine 210 to utilize one or more lookup tables to translate the RNG outcome to a symbol element, stop position on a reel strip layout, and/or randomly chosen aspect of a game feature. As an example, the lookup tables can regulate a prize payout amount for each RNG outcome and how often the gaming device 200 pays out the prize payout amounts. The RNG conversion engine 210 could utilize one lookup table to map the RNG outcome to a game outcome displayed to a player and a second lookup table as a pay table for determining the prize payout amount for each game outcome. The mapping between the RNG outcome to the game outcome controls the frequency in hitting certain prize payout amounts.

FIG. 2 also depicts that gaming device 200 is connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

When a player wishes to play the gaming device 200, he/she can insert cash or a ticket voucher through a coin acceptor (not shown) or bill validator 234 to establish a credit balance on the gamine device. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views with one or more UIs, the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round, selecting various items during a feature game, and/or predicting an outcome of a historical race). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Although FIGS. 1 and 2 illustrates specific embodiments of a gaming device (e.g., gaming devices 104A-104X and 200), the disclosure is not limited to those embodiments shown in FIGS. 1 and 2. For example, not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or tabletops and have displays that face upwards. Additionally, or alternatively, gaming devices 104A-104X and 200 can include credit transceivers that wirelessly communicate (e.g., Bluetooth or other near-field communication technology) with one or more mobile devices to perform credit transactions. As an example, bill validator 234 could contain or be coupled to the credit transceiver that output credits from and/or load credits onto the gaming device 104A by communicating with a player's smartphone (e.g., a digital wallet interface). Gaming devices 104A-104X and 200 may also include other processors that are not separately shown. Using FIG. 2 as an example, gaming device 200 could include display controllers (not shown in FIG. 2) configured to receive video input signals or instructions to display images on game displays 240 and 242. Alternatively, such display controllers may be integrated into the game controller 202. The use and discussion of FIGS. 1 and 2 are examples to facilitate ease of description and explanation.

Figure 3:
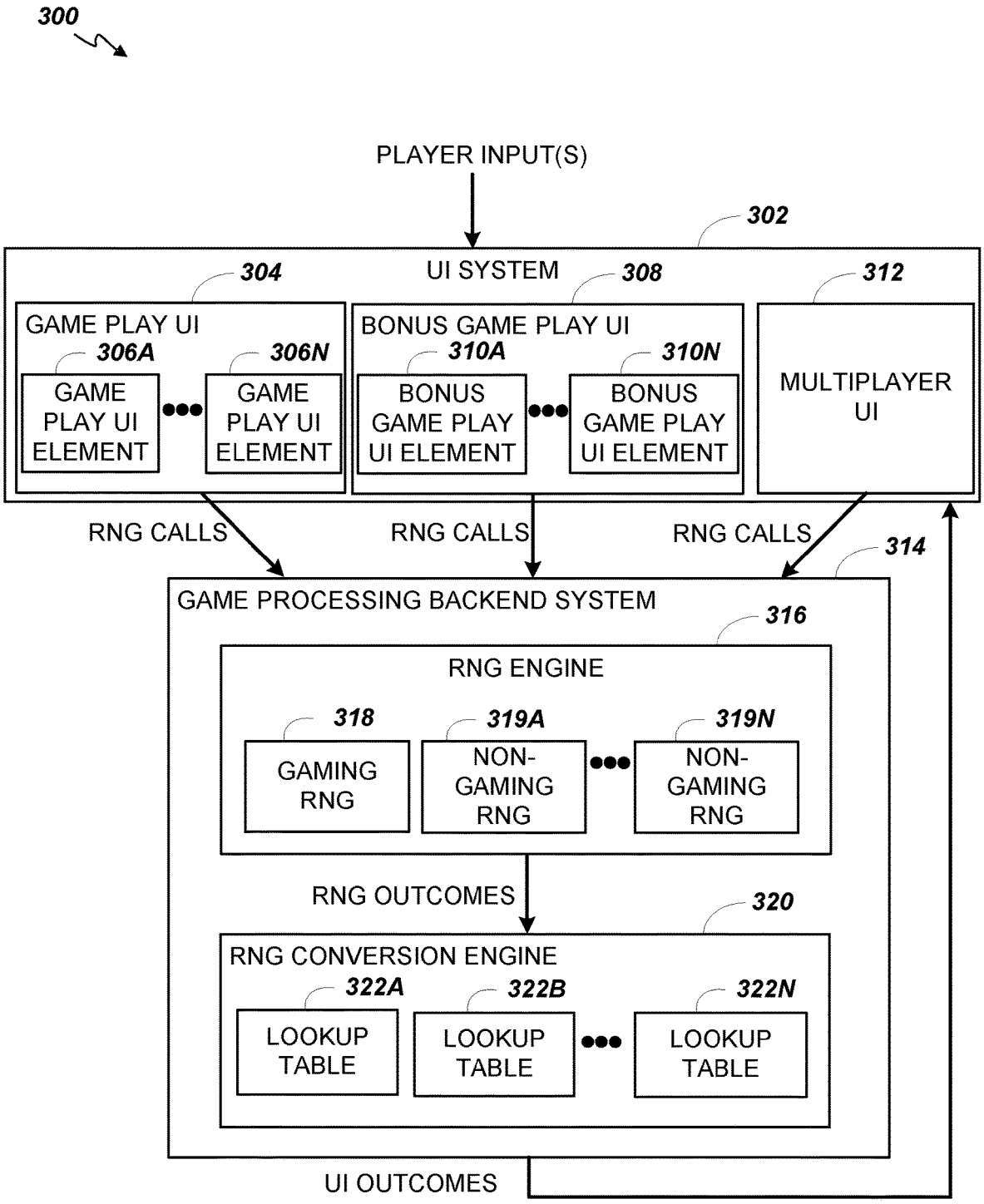
FIG. 3 illustrates, in block diagram form, an embodiment of a game processing architecture algorithm that implements a game processing pipeline for the play of a game in accordance with various embodiments described herein.

FIG. 3 illustrates, in block diagram form, an embodiment of a game processing architecture 300 that implements a game processing pipeline for the play of a game in accordance with various embodiments described herein. As shown in FIG. 3, the gaming processing pipeline starts with having a UI system 302 receive one or more player inputs for the game instance. Based on the player input(s), the UI system 302 generates and sends one or more RNG calls to a game processing backend system 314. Game processing backend system 314 then processes the RNG calls with RNG engine 316 to generate one or more RNG outcomes. The RNG outcomes are then sent to the RNG conversion engine 320 to generate one or more game outcomes for the UI system 302 to display to a player. The game processing architecture 300 can implement the game processing pipeline using a gaming device, such as gaming devices 104A-104X and 200 shown in FIGS. 1 and 2, respectively. Alternatively, portions of the gaming processing architecture 300 can implement the game processing pipeline using a gaming device and one or more remote gaming devices, such as central determination gaming system server 106 shown in FIG. 1.

The UI system 302 includes one or more UIs that a player can interact with. The UI system 302 could include one or more game play UIs 304, one or more bonus game play UIs 308, and one or more multiplayer UIs 312, where each UI type includes one or more mechanical UIs and/or graphical UIs (GUIs). In other words, game play UI 304, bonus game play UI 308, and the multiplayer UI 312 may utilize a variety of UI elements, such as mechanical UI elements (e.g., physical "spin" button or mechanical reels) and/or GUI elements (e.g., virtual reels shown on a video display or a virtual button deck) to receive player inputs and/or present game play to a player. Using FIG. 3 as an example, the different UI elements are shown as game play UI elements 306A-306N and bonus game play UI elements 310A-310N.

The game play UI 304 represents a UI that a player typically interfaces with for a base game. During a game instance of a base game, the game play UI elements 306A-306N (e.g., GUI elements depicting one or more virtual reels) are shown and/or made available to a player. In a subsequent game instance, the UI system 302 could transition out of the base game to one or more bonus games. The bonus game play UI 308 represents a UI that utilizes bonus game play UI elements 310A-310N for a player to interact with and/or view during a bonus game. In one or more embodiments, at least some of the game play UI element 306A-306N are similar to the bonus game play UI elements 310A-310N. In other embodiments, the game play UI element 306A-306N can differ from the bonus game play UI elements 310A-310N.

FIG. 3 also illustrates that UI system 302 could include a multiplayer UI 312 purposed for game play that differ or is separate from the typical base game. For example, multiplayer UI 312 could be set up to receive player inputs and/or presents game play information relating to a tournament mode. When a gaming device transitions from a primary game mode that presents the base game to a tournament mode, a single gaming device is linked and synchronized to other gaming devices to generate a tournament outcome. For example, multiple RNG engines 316 corresponding to each gaming device could be collectively linked to determine a tournament outcome. To enhance a player's gaming experience, tournament mode can modify and synchronize sound, music, reel spin speed, and/or other operations of the gaming devices according to the tournament game play. After tournament game play ends, operators can switch back the gaming device from tournament mode to a primary game mode to present the base game. Although FIG. 3 does not explicitly depict that multiplayer UI 312 includes UI elements, multiplayer UI 312 could also include one or more multiplayer UI elements.

Based on the player inputs, the UI system 302 could generate RNG calls to a game processing backend system 314. As an example, the UI system 302 could use one or more application programming interfaces (APIs) to generate the RNG calls. To process the RNG calls, the RNG engine 316 could utilize gaming RNG 318 and/or non-gaming RNGs 319A-319N. Gaming RNG 318 corresponds to RNG 212 shown in FIG. 2. As previously discussed with reference to FIG. 2, gaming RNG 318 often performs specialized and non-generic operations that comply with regulatory and/or game requirements. For example, because of regulation requirements, gaming RNG 318 could be a cryptographic random or pseudorandom number generator (PRNG) (e.g., Fortuna PRNG) that securely produces random numbers for one or more game features. To generate random numbers, gaming RNG 318 could collect random data from various sources of entropy, such as from an operating system (OS). Alternatively, non-gaming RNGs 319A-319N may not be cryptographically secure and/or be computationally less expensive. Non-gaming RNGS 319A-319N can, thus, be used to generate outcomes for non-gaming purposes. As an example, non-gaming RNGs 319A-319N can generate random numbers for such as generating random messages that appear on the gaming device.

The RNG conversion engine 320 processes each RNG outcome from RNG engine 316 and converts the RNG outcome to a UI outcome that is feedback to the UI system 302. With reference to FIG. 2, RNG conversion engine 320 corresponds to RNG conversion engine 210 used for game play. As previously described, RNG conversion engine 320 translates the RNG outcome from the RNG 212 to a game outcome presented to a player. RNG conversion engine 320 utilizes one or more lookup tables 322A-322N to regulate a prize payout amount for each RNG outcome and how often the gaming device pays out the derived prize payout amounts. In one example, the RNG conversion engine 320 could utilize one lookup table to map the RNG outcome to a game outcome displayed to a player and a second lookup table as a pay table for determining the prize payout amount for each game outcome. In this example, the mapping between the RNG outcome and the game outcome controls the frequency in hitting certain prize payout amounts. Different lookup tables could be utilized depending on the different game modes, for example, a base game versus a bonus game.

After generating the UI outcome, the game processing backend system 314 sends the UI outcome to the UI system 302. Examples of UI outcomes are symbols to display on a video reel or reel stops for a mechanical reel. In one example, if the UI outcome is for a base game, the UI system 302 updates one or more game play UI elements 306A-306N, such as symbols, for the game play UI 304. In another example, if the UI outcome is for a bonus game, the UI system could update one or more bonus game play UI elements 310A-310N (e.g., symbols) for the bonus game play UI 308. In response to updating the appropriate UI, the player may subsequently provide additional player inputs to initiate a subsequent game instance that progresses through the game processing pipeline.

Figure 4:
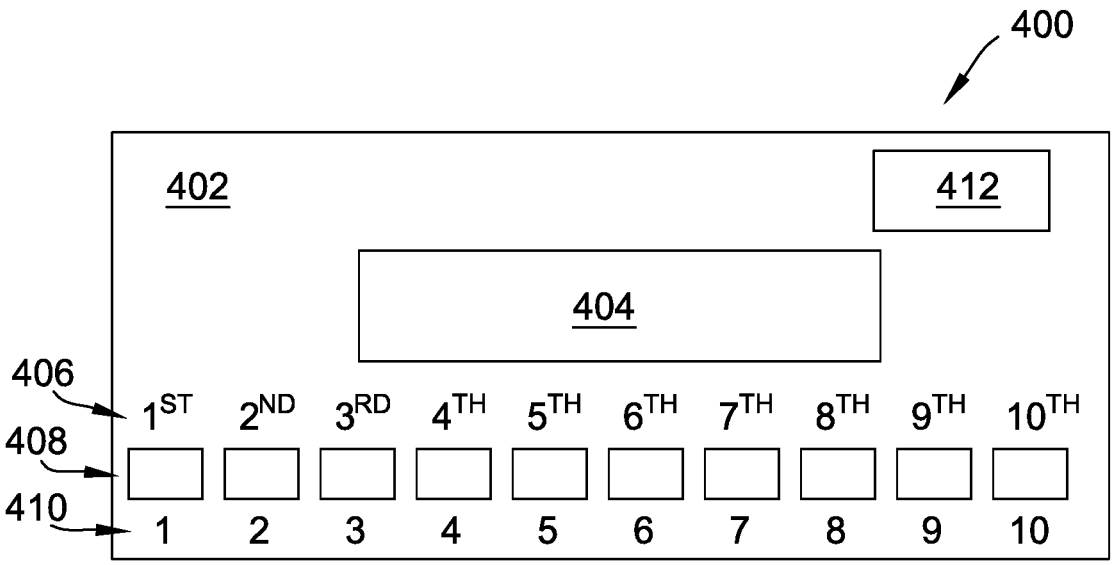
FIGS. 4 and 5 depict exemplary display areas on a display device of an EGM during gameplay as described herein.

FIG. 4 is an exemplary display 400 including a display area 402 on an EGM (e.g., EGMs 104A -104X) during gameplay as described herein. In some embodiments, display 400 may be similar to display 128 (shown in FIG. 1). In the example embodiment, display area 402 includes a first display area 404, a first row 406 indicating a number of place finishes (e.g., first, second, etc.), a second row 408 indicating predicted finishes (e.g., by a player or processor 204), a third row 410 including symbols indicating participants in a historical event, and a second display area 412.

A player may initiate play of a wagering game on display area 402 by, for example, loading credits onto a gaming device associated therewith. In the example embodiment, the EGM including display area 402 is configured to conduct a historical horse racing (HHR) game as described herein. In some embodiments, the EGM may conduct a game similar to an HHR game such as a historical dog racing game. In some embodiments, the EGM may conduct any game using historical data. Accordingly, the systems and methods described herein are not limited to HHR games.

Upon initiating gameplay, a game controller (e.g., game controller 202) causes first display area 404 to present a player with information associated with a historical event. For example, memory 208 may store a plurality of sets of historical horse race outcomes, and other details about the historical horse races. A set of races may include, as an example, four races. In some embodiments, a set of races may include any number of races, including a single race. For example, upon initiating gameplay, processor 204 of game controller 202 may transmit a signal to RNG 212 and/or game processing backend engine 314 to generate an RNG outcome. The RNG outcome is then transmitted to RNG conversion engine 210, which utilizes a lookup table (e.g., lookup tables 322A-322N) along with the RNG outcome to determine a set of races, of the plurality of sets of races stored in memory 208, for use in a particular play of the wagering game. Details of the set of races determined for a particular play of the wagering game are then displayed on first display area 404. Details of the set of races displayed on first display area 404 may include details a player may use in making predictions for the outcome of a historical horse race such as, as examples, a winning percentage for horses, trainers, and jockeys entered in a race. In the example embodiment, more specific information about a race, such as a date or location of a race, is not displayed to a player because that would enable a player to more easily determine which historical race(s) are being used in that play of the wagering game.

Figure 5:
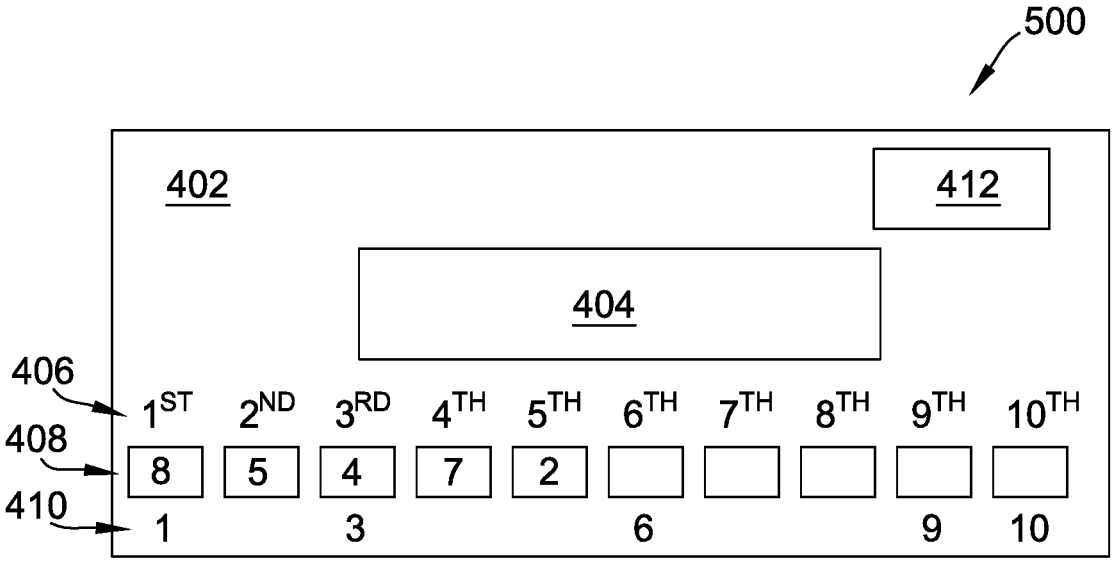

In the example embodiment, symbols representing horses in a race in the set of races being used in the wagering game may be displayed in third row 410 as numbers one through ten. In some embodiments, the symbols (e.g., numbers) in third row 410 are the post numbers of the horses in a race in the set of races being used in the wagering game. Finishing places in a race may be displayed in first row 406. A player of the wagering game may be able to interact with the EGM at, for example, game play UI 304, to predict finishing places of any number of horses with symbols displayed in third row 410. Upon player selection of a horse finishing in a certain position, the number in third row 410 associated with that horse is then displayed in second row 408 underneath the predicted place of the horse (i.e., manually handicapping). In some embodiments, the symbols displayed in third row 410 correspond to different horses that appear in an order based upon post-time odds (e.g., the projected finishes of horses in a race at the time of the historical horse race). For example, if horse six was projected to finish in first place (e.g., based on betting odds) at post time of the historical race, the number six would appear farthest to the left in row 410. If horse four was projected to finish in second place, the number four would appear immediately to the right of the number six, and so forth. FIG. 5, as an example, demonstrates a display 500 including display area 402 wherein a player has selected horse eight to finish first, horse five to finish second, horse four to finish third, horse seven to finish fourth, and horse two to finish fifth. Accordingly, horses one, three, six, nine, and ten remain in third row 410 because no player predictions have been made regarding those horses. In some embodiments, processor 204 may be configured to automatically generate predictions for a player (i.e., "Handi Helper" or "Auto-Cap"). In some embodiments, processor 204 make all of the predictions for a player, while in some embodiments processor 204 may complete a set of predictions after a player has made some predictions. For example, in FIG. 5 a player has predicted finishing positions one through five, and processor 204 will complete the predictions for finishing positions six through ten. In some embodiments, processor 204 may utilize RNG 212 to generate predictions. In some embodiments, processor 204 may use details of the set of races stored in memory 208 when generating predictions (e.g., horse winning percentage, etc.). In some embodiments, processor 204 may use post-time odds to automatically make projections for a player (e.g., furthering the example above, by picking horse six to finish first, horse four to finish second, and so forth in accordance with post-time odds of the historical race).

In the example embodiment, predictions made by a player and/or predictions made by processor 204 may be made for each race in the set of races being used in the wagering game. In some embodiments, after predictions have been made, processor 204 is configured to divide the wager placed by a player into a plurality of wagers (e.g., sub-wagers). For example, some jurisdictions may require a win of a wagering game pay out at least the amount wagered. Thus, it may be desirable to divide a wager into a plurality of sub-wagers. In the example embodiment, the wager placed by the player is divided by processor 204 into a plurality of sub-wagers. The number of sub-wagers and amount of each sub-wager may be determined at least in part by RNG 212 and RNG conversion engine 210 by utilizing one or more lookup tables 322A-322N.

In the example embodiment, processor 204 is also configured to determine a plurality of arrangements of historical event data associated with the set of historical events being used during play of the wagering game. An arrangement of historical event data may include, for example, an indication of patterns to be used to identify winning outcomes in the wagering game. For example, an arrangement/pattern of horse racing data may indicate that a winning outcome of the wagering game occurs if a player correctly predicts the first three finishing horses in a particular historical horse race in the set of historical horse races being used in the wagering game.

FIG. 6 is an exemplary diagram 600 (e.g., pay table) demonstrating a plurality of sub-wagers matched to a plurality of historical event outcomes. Diagram 600 shows a set of historical races 602, a plurality of sub-wagers 604, 608 that may each be associated with different wager amounts as divided from an initial wager received from a player, and a plurality of arrangements of historical data 606, 610 indicating winning outcomes of the wagering game for a particular wager 604, 608. In some embodiments, processor 204 is configured to determine one arrangement for each wager, as divided by processor 204. For example, processor 204 may divide a wager into five wagers. Processor 204 would then determine five patterns of historical data, one to be associated with each of the five wagers as shown in FIG. 6.

In the example shown in FIG. 6, a first wager amount (W1) is associated with places one through three in a first historical race, a second wager amount (W2) is associated with places two and four in the first historical race, a third wager amount (W3) is associated with first place in a second historical race, and so forth. Notably, different arrangements of the same race may be associated with different sub-wagers in the same play of the wagering game (e.g., places one through three associated with the first wager amount and places six through eight associated with the second wager amount). Accordingly, in the example shown in FIG. 6, if a player playing the wagering game correctly predicts horses finishing in places one through three of the first race, the player would win an award associated with the first wager amount. If the player playing the wagering game correctly predicted horses finishing in places two and four in the first race, the player would win an award associated with the second wager amount, and so forth. In the example embodiment, all awards won by a player during play of the wagering game are combined into a single award presented to the player.

In some embodiments, a wager may be divided into smaller wagering amounts of the same amount (e.g., a fifty cent wager divided in to five ten cent wagers). In some embodiments, a wager may be divided in to different wagering amounts (e.g., a fifty cent wager divided in to one thirty cent wager, and four five cent wagers).

FIGS. 7A and 7B illustrate exemplary diagrams 700, 710 (e.g., pay tables) each demonstrating a set of historical data and arrangements of historical data. Diagram 700 shows a set of historical races 702 and an arrangement of historical data 704. Diagram 700 demonstrates one of the arrangements of historical data 704 (i.e., pay tables) that may be used when determining an outcome of the wagering game. Any number of arrangements of historical data 704, 712 may be evaluated with the same set of historical races 702 in the wagering game. In other words, set of historical races 702 (races one through ten in FIGS. 7A and 7B) may be evaluated against any number of different arrangements of historical data 704, 712. The different arrangements of historical data 704 may be completely different, or overlap (e.g., evaluate at least some of the same finishing positions of the same race). In the example embodiment, each different sub-wager, upon an initial wager amount being divided into sub-wagers, is associated, by processor 204, with a different arrangement of historical data. In other words, as shown in FIGS. 7A and 7B, a first sub-wager is associated with arrangement of historical data 704, a second sub-wager is associated with arrangement of historical data 712, and each other wager is associated with a different arrangement of historical data. Notably, some arrangements of historical data (e.g., arrangement of historical data 712) may not require correct predictions for each race in a set of horse races 702 to win an award associated therewith (e.g., no correct predictions are required for Races 2, 3, 5, and 8 in FIG. 7B). In some embodiments, larger awards may be associated with arrangements of historical data requiring more correct predictions. For example, a larger award may be associated with arrangement of historical data 704 than arrangement of historical data 712 because arrangement of historical data 712 requires fewer correct predictions than arrangement of historical data 704. In some embodiments, larger awards are associated with larger sub-wagers. The matching of each wager to a different arrangement of historical data may be determined by processor 204 in communication with RNG 212. Utilizing RNG 212 in this process creates more difficulty for a player to accurately determine which historical events and/or arrangements of historical data may be used during play of any particular wagering game.

As an example, say arrangements 704 and 712 each have a sub-wager assigned thereto during play of the wagering game described herein, and a player correctly predicted the finishing positions shown in arrangement 712 for the set of historical races 702, but not the finishing positions shown in arrangement 704 for the set of historical races 702. In this example, processor 204 determines a winning outcome has occurred because the player correctly predicted the finishing places shown in arrangement 712, and arrangement 712 has a sub-wager associated therewith. Upon determining the player correctly predicted the finishing positions shown in arrangement 712, processor 204 determines an award to present to the player by, for example, determining an award value associated with arrangement 712 (e.g., by multiplying the sub-wager associated with arrangement 712 by a predetermined amount), combining all the awards to be presented to the player (e.g., if the player also correctly predicted finishing positions of other arrangements for the set of historical races 702 having a sub-wager assigned thereto), and presenting the combined award to the player at the EGM.

In some embodiments, arrangements of historical data may be determined by processor 204 to be evaluated against a set of historical races based on a payout, or return, to the player if the player does not manually select the race result predictions, as described above. For example, if no player selection is made as to the finishing results of a race or races in the set of races, the EGM may determine a payout to be made to the player. In some embodiments, based on the payout determined by the EGM, processor 204 selects arrangements of historical data to be applied to the set of historical races such that the determined payout will be made to the player. In some embodiments, the EGM may determine the payout to be made to the player in accordance with RTP (return to player, as described above) requirements. For example, if processor 204 determines a payout of two times the wager made by the player is to be returned to the player, if the player does not manually select any predictions, processor 204 determines a set of historical races and arrangements of historical data that will result in the player winning two times the wager made. If the player chooses to manually select predictions in these embodiments, the payout may either increase or decrease depending on if the user improves the automatic predictions or not. In these embodiments, by determining the set of historical races and arrangements of historical data based on a determined payout to be made, RTP is more efficiently controlled and regulatory requirements may be more easily met by the systems and methods described herein.

Notably, in the example embodiment, only one set of historical races 702 is used in any particular play of the wagering game. Because only one set of historical races 702 is utilized, game programmers can more easily configure and create HHR games and/or other games using historical data. It is much more difficult to create games using historical data when wagers are divided and each resulting sub-wager is associated with a different set of historical data, as opposed to each resulting sub-wager being associated with a different arrangement of the same set of historical data.

As noted above, the wagering game associated with the systems and methods described herein may provide awards to players based on winning outcomes in a parimutuel fashion. In other words, wagers placed by players may have a "house take" deducted therefrom, and the remaining portion of the wager may be placed in a betting pool. Prizes/awards generated because of winning outcomes of the wagering game are then deducted from the betting pool and presented to the player. In some embodiments, different pay tables may be used during play of the wagering game described herein based on the balance of the betting pool being used. For example, if the balance of the pool is negative, a pay table with lower RTP is used while if the balance of the pool is positive, a pay table with higher RTP is used. This example helps prevent high fluctuation of the balance of the betting pools.

After each sub-wager is associated with an arrangement of historical data (e.g., 704 and 712), a game outcome is determined by processor 204 based at least in part on the player and/or processor 204 generated predictions, the sub-wagers (or single wager, in some embodiments), and the arrangements of historical data. For example, outcomes are determined based at least on the player and/or processor 204 correctly predicting outcomes for finishing places indicated by arrangements of historical data determined to be used in the wagering game. Processor 204 then determines awards for correctly predicted outcomes. The awards are then presented to the player at the EGM operating the wagering game.

Before an award is presented to a player, animations, video recordings of historical events, or other presentations may be displayed on display area 402 including first display area 404 and second display area 412, or any other display (e.g., topper screen 140, secondary display 128B, etc.). For example, furthering the example described above, at least a portion of a horse race in set of horse races 702 may be displayed on second display area 412, first display 404, or any other display.

In some embodiments, an indication of an outcome of the wagering game may be presented as a spin and stop of virtual slot-style reels or any other wagering game known in the art (e.g., a card game outcome, a bingo game outcome, etc.) on first display area 404, or any other display. In typical slot-style games, symbol positions on the reels matching pay lines for a particular game communicate a winning outcome to a player. Accordingly, players more familiar with slot-style games will be able to better understand outcomes of the HHR game when the HEIR game outcomes are displayed as slot-style game outcomes.

In the example embodiment, the presentation of a spin and stop of virtual reels communicates the outcome of the HHR game. In these examples, a player is not wagering on pay lines associated with the reels, as is the case in some slot-style games. Rather, the final symbol positions of symbols on the reels communicate the outcome of the HHR game as described herein. In other words, in some embodiments, the outcome of the HHR game is determined, and then the HHR game outcome is used in a lookup table to determine which slot-style outcome should be displayed on the reels. Accordingly, winning HHR game outcomes being determined will result in winning slot-style game outcomes being displayed, and losing HHR game outcomes being determined will result in losing slot-style game outcomes being displayed.

Figure 8:
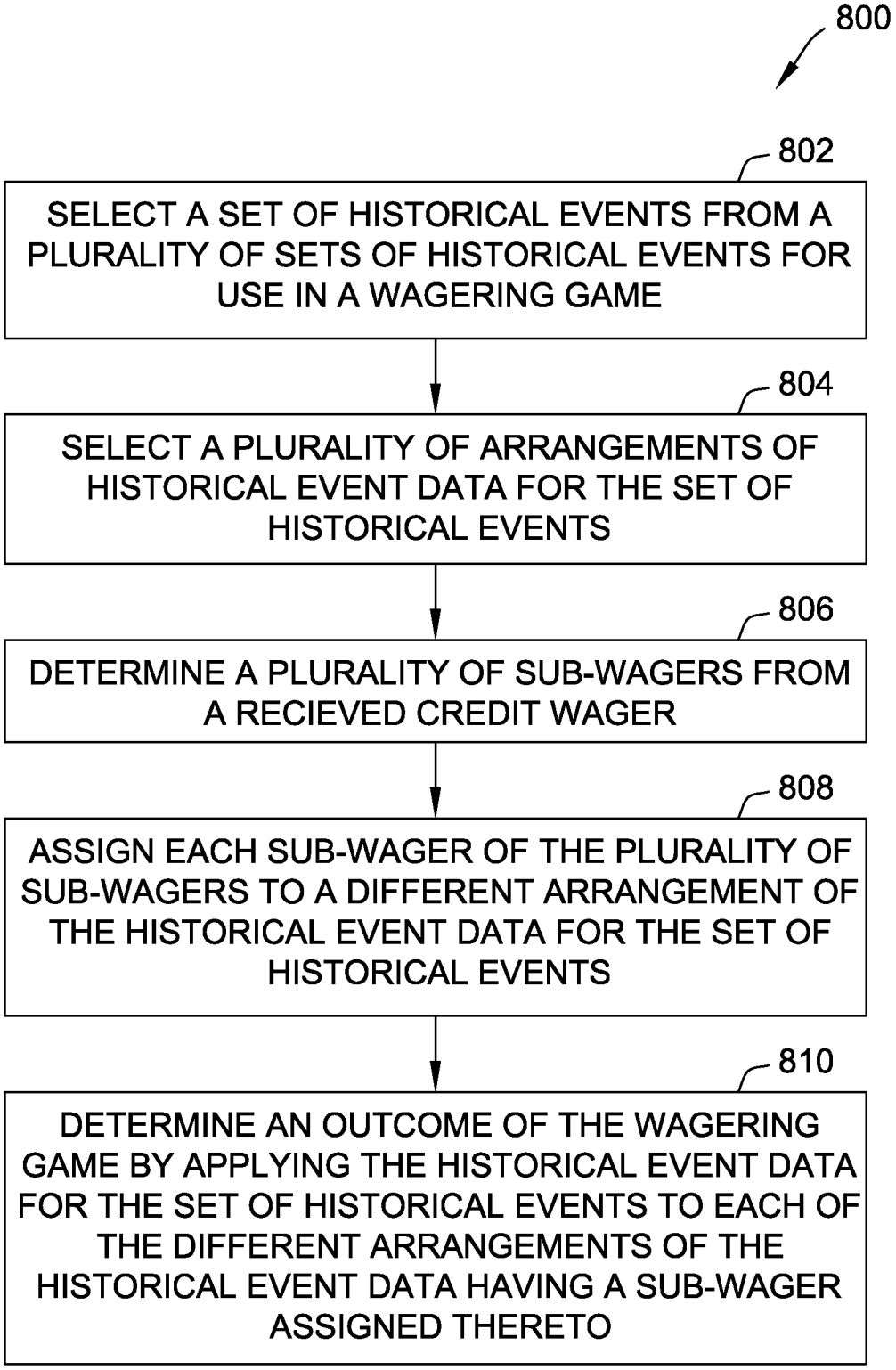
FIG. 8 is an exemplary method of electronic gaming using historical data as described herein.

FIG. 8 is an exemplary method 800 of electronic gaming using historical data as described herein. Method 800 includes selecting 802 a set of historical events from a plurality of sets of historical events (e.g., set of races 602, 702) for use in a wagering game, each of the plurality of sets of historical events having historical event data associated therewith and stored in a memory (e.g., memory 208), selecting 804 a plurality of arrangements of historical event data (e.g., arrangements 704, 712) associated with the set of historical events, and determining 806 a plurality of sub-wagers from a received credit wager. Method 800 also includes assigning 808 each sub-wager of the plurality of sub-wagers to a different arrangement of the historical event data for the set of historical events and determining 810 an outcome of the wagering game by applying the historical event data for the set of historical events to each of the different arrangements of the historical event data having a sub-wager assigned thereto.

In some embodiments, method 800 includes automatically determining a predicted result for a result of at least one historical event of the set of historical events and/or receiving player input modifying the predicted result for the result of the at least one historical event of the set of historical events. In some embodiments, method 800 includes causing to be displayed at least a portion of a historical event of the set of historical events and/or causing to be displayed an animation indicating an outcome of the wagering game. In some embodiments, the set of historical events in method 800 includes historical horse race outcomes and/or historical dog race outcomes.

While many embodiments described herein include description of various steps performed by processor 204, it should be noted that these steps may be performed by any of a variety of devices. These devices include, as examples, central determination gaming system server 106, a third-party server, or any other server. For example, a third-party server may be used to store sets of historical data 702 and/or parimutuel betting pools as described above. Additionally, any number of sets of historical races 702 and arrangements of historical data 704 may be used to form pay tables.

As an example, after a player initiates play of the HEIR game described herein, a set of historical data 702 may be received at an EGM (e.g., EGMS 104A-104X) from a server. A win amount is then determined by the EGM (or a server) based on a probability distribution defined for the specific HHR game being played on the EGM.

In some embodiments, probability distributions used to determine win amounts may have different configurations. As an example, a table including all of the unique win values (e.g., predetermined outcomes) to be emulated by the game includes win values wherein each win value is associated with a weight relating to the probability of a player achieving that win. As another example, a win value may be randomly selected (e.g., by use of RNG 212) from a pool including a variety of potential win values. In these embodiments, the probability of a player achieving a certain win amount is determined by the amount of times each win amount appears in the pool. In some embodiments of this example, once a win value is selected from the pool, that value is replaced (e.g., to maintain the probability of a player achieving each win). In other embodiments of this example, a selected win value is not replaced in the pool (e.g., to reduce variations in RTP over a period of time).

After the win amount is determined, at least one arrangement of historical data (e.g., arrangement 704, otherwise described as an auto-pick hit pattern arrangement) is retrieved from a table (e.g., lookup tables 322A-322N) as being indexed to the determined win amount. In some embodiments, arrangements/patterns stored in the table are predetermined such that they match specific win values in a pay table. The arrangements are then used, in combination with the outcomes of the races in the set of historical races being used for a particular play of the game, to fill in post numbers (e.g., predicted outcomes for each race in the set of historical races). The post numbers are then displayed to a player (e.g., in display area 402 shown in FIGS. 4 and 5), such that the post numbers are consistent with the arrangements of historical data and the determined win amount (e.g., such that if the player does not modify the order of the post numbers, the player will win the determined win amount). In some embodiments, where a wager placed by a player is divided into sub-wagers, and each sub-wager is associated with an arrangement of historical data, each arrangement of historical data is displayed to the player along with the amount of the sub-wager associated with each arrangement of historical data.

Data regarding animations displayed to communicate the game outcome to the player (e.g., slot reels spinning) is then retrieved from a table based at least in part on the determined win value and/or any changes to the post numbers by the player, thus resulting in a win value different from the determined win value.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electronic gaming machine comprising:

at least one display device;

a player input interface configured to receive player input from a player;

a credit input operable to establish a credit balance;

a game controller configured to execute instructions stored in a tangible, non-transitory, computer-readable storage medium, which, when executed by the game controller, cause the game controller to at least:

establish a credit balance based upon an input at the credit input;

select a set of historical events from a plurality of sets of historical events for use in an electronic game, each of the plurality of sets of historical events having historical event data associated therewith and stored in a memory, wherein each set of the plurality of sets of historical events includes a plurality of historical events;

determine a plurality of sub-balances from the credit balance;

assign the set of historical events to each sub-balance of the plurality of sub-balances such that each sub-balance has the same set of historical events assigned thereto;

in response to an input at the player input interface, determine a predicted order of finish for each historical event of the set of historical events assigned to each sub-balance;

select a plurality of arrangements for the set of historical events assigned to each sub-balance;

assign each sub-balance of the plurality of sub-balances to a different arrangement of the selected plurality of arrangements; and determine an outcome of the electronic game by comparing each predicted order of finish to the historical event data for the set of historical events based upon the different arrangements of the historical event data having a sub-balance assigned thereto.

2. The electronic gaming machine of claim 1 wherein the instructions further cause the game controller to automatically determine a predicted result for a result of at least one historical event of the set of historical events.

3. The electronic gaming machine of claim 2 wherein the instructions further cause the game controller to receive player input modifying the predicted result for the result of the at least one historical event of the set of historical events.

4. The electronic gaming machine of claim 1 wherein the instructions further cause the game controller to cause to be displayed at least a portion of a historical event of the set of historical events.

5. The electronic gaming machine of claim 1 wherein the instructions further cause the game controller to cause to be displayed an animation indicating an outcome of the electronic game.

6. The electronic gaming machine of claim 1 wherein the instructions further cause the game controller to determine at least one winning outcome of the electronic game, and determine at least one award based at least on an arrangement of the historical event data having a sub-balance assigned thereto.

7. The electronic gaming machine of claim 1 wherein the instructions further cause the game controller to select the plurality of arrangements for the set of historical events based at least in part on a predetermined outcome of the electronic game.

8. The electronic gaming machine of claim 7, wherein the instructions further cause the game controller to randomly select the predetermined outcome of the electronic game from a pool of predetermined outcomes stored in a memory device, wherein the electronic gaming machine is communicatively coupled to the memory device.

9. An electronic gaming system comprising:

at least one display device;

a player input interface configured to receive player input from a player;

a processor for controlling an electronic game; and a tangible, non-transitory, computer-readable storage medium having instructions stored thereon that, in response to execution by the processor, cause the processor to perform operations comprising:

establishing a credit balance based upon a received input;

selecting a set of historical events from a plurality of sets of historical events for use in an electronic game, each of the plurality of sets of historical events having historical event data associated therewith and stored in a memory, wherein each set of the plurality of sets of historical events includes a plurality of historical events;

determining a plurality of sub-balances from the credit balance;

assigning the set of historical events to each sub-balance of the plurality of sub-balances such that each sub-balance has the same set of historical events assigned thereto;

in response to an input at the player input interface, determining a predicted order of finish for each historical event of the set of historical events assigned to each sub-balance;

selecting a plurality of arrangements for the set of historical events assigned to each sub-balance;

assigning each sub-balance of the plurality of sub-balances to a different arrangement of the selected plurality of arrangements; and determining an outcome of the electronic game by comparing each predicted order of finish to the historical event data for the set of historical events based upon the different arrangements of the historical event data having a sub-balance assigned thereto.

10. The electronic gaming system of claim 9 wherein the instructions further cause the processor to perform operations comprising automatically determining a predicted result for a result of at least one historical event of the set of historical events.

11. The electronic gaming system of claim 10 wherein the instructions further cause the processor to perform operations comprising receiving player input modifying the predicted result for the result of the at least one historical event of the set of historical events.

12. The electronic gaming system of claim 9 wherein the instructions further cause the processor to perform operations comprising causing to be displayed at least a portion of a historical event of the set of historical events.

13. The electronic gaming system of claim 9 wherein the instructions further cause the processor to perform operations comprising causing to be displayed an animation indicating an outcome of the electronic game.

14. The electronic gaming system of claim 9 wherein the set of historical events comprises a set of historical horse races.

15. A method for electronic gaming on an electronic gaming machine including at least one display device, a player input interface configured to receive player input from a player, a credit input operable to establish a credit balance, and a game controller configured to execute instructions stored in a tangible, non-transitory, computer-readable storage medium, the method comprising:

establishing a credit balance based upon an input at the credit input;

selecting a set of historical events from a plurality of sets of historical events for use in an electronic game, each of the plurality of sets of historical events having historical event data associated therewith and stored in a memory, wherein each set of the plurality of sets of historical events includes a plurality of historical events;

determining a plurality of sub-balances from the credit balance;

assigning the set of historical events to each sub-balance of the plurality of sub-balances such that each sub-balance has the same set of historical events assigned thereto;

in response to an input at the player input interface, determining a predicted order of finish for each historical event of the set of historical events assigned to each sub-balance;

selecting a plurality of arrangements for the set of historical events assigned to each sub-balance;

assigning each sub-balance of the plurality of sub-balances to a different arrangement of the selected plurality of arrangements; and determining an outcome of the electronic game by comparing each predicted order of finish to the historical event data for the set of historical events based upon the different arrangements of the historical event data having a sub-balance assigned thereto.

16. The method of claim 15 further comprising automatically determining a predicted result for a result of at least one historical event of the set of historical events.

17. The method of claim 16 further comprising receiving player input modifying the predicted result for the result of the at least one historical event of the set of historical events.

18. The method of claim 15 further comprising to causing to be displayed at least a portion of a historical event of the set of historical events.

19. The method of claim 15 further comprising causing to be displayed an animation indicating an outcome of the electronic game.

20. The method of claim 15 wherein the set of historical events comprises a set of historical horse races.

* * * * *